US011116288B2

(12) United States Patent
Taylor et al.

(10) Patent No.: US 11,116,288 B2
(45) Date of Patent: Sep. 14, 2021

(54) STRAP TIE-DOWN

(71) Applicant: Process4, Inc., Chagrin Falls, OH (US)

(72) Inventors: Curtis Taylor, Chagrin Falls, OH (US); Matthew Hanson, Chagrin Falls, OH (US); David G. Hudak, Chagrin Falls, OH (US)

(73) Assignee: Chagrinovations, LLC, Naples, FL (US)

( * ) Notice: Subject to any disclaimer, the term of this patent is extended or adjusted under 35 U.S.C. 154(b) by 0 days.

(21) Appl. No.: 16/441,869

(22) Filed: Jun. 14, 2019

(65) Prior Publication Data

US 2019/0380450 A1 Dec. 19, 2019

Related U.S. Application Data

(60) Provisional application No. 62/685,430, filed on Jun. 15, 2018.

(51) Int. Cl.
*A44B 11/06* (2006.01)

(52) U.S. Cl.
CPC ..... *A44B 11/065* (2013.01)

(58) Field of Classification Search
CPC . A44B 11/065; A44B 11/125; Y10T 24/2175; Y10T 24/2113; Y10T 24/2121; Y10T 24/2102; Y10T 24/2147
See application file for complete search history.

(56) References Cited

U.S. PATENT DOCUMENTS

| | | | | |
|---|---|---|---|---|
| 2,852,827 | A * | 9/1958 | Garland | B60P 7/0838 24/68 R |
| 4,796,336 | A * | 1/1989 | Scully | A44B 11/125 24/196 |
| 7,231,693 | B2 * | 6/2007 | Wilcox | B60P 7/0861 24/68 CD |
| 8,291,552 | B2 * | 10/2012 | Gopal | A44B 11/125 24/68 CD |
| 2003/0041420 | A1 * | 3/2003 | Kosh | A44B 11/12 24/193 |
| 2003/0131451 | A1 * | 7/2003 | Brown | A44B 11/125 24/68 CD |
| 2004/0075088 | A1 * | 4/2004 | Rard | A44B 11/125 254/199 |
| 2005/0283951 | A1 * | 12/2005 | Chang | A44B 11/125 24/68 CD |
| 2006/0075609 | A1 * | 4/2006 | Dingman | B60R 22/20 24/68 CD |
| 2007/0193001 | A1 * | 8/2007 | Huang | A44B 11/065 24/71 ST |
| 2009/0106957 | A1 * | 4/2009 | Chang | B25B 25/00 24/68 CD |
| 2009/0133234 | A1 * | 5/2009 | Chang | B60P 7/0838 24/68 CD |
| 2010/0275420 | A1 * | 11/2010 | Huang | B60P 7/0838 24/68 CD |

* cited by examiner

*Primary Examiner* — Robert Sandy
*Assistant Examiner* — Rowland Do
(74) *Attorney, Agent, or Firm* — Ulmer & Berne LLP; Brian E. Turung

(57) ABSTRACT

An improved strap tie-down device that includes two primary components, namely a base frame and a lever arm, and further includes a cam and a locking mechanism.

10 Claims, 9 Drawing Sheets

FIG. 2A
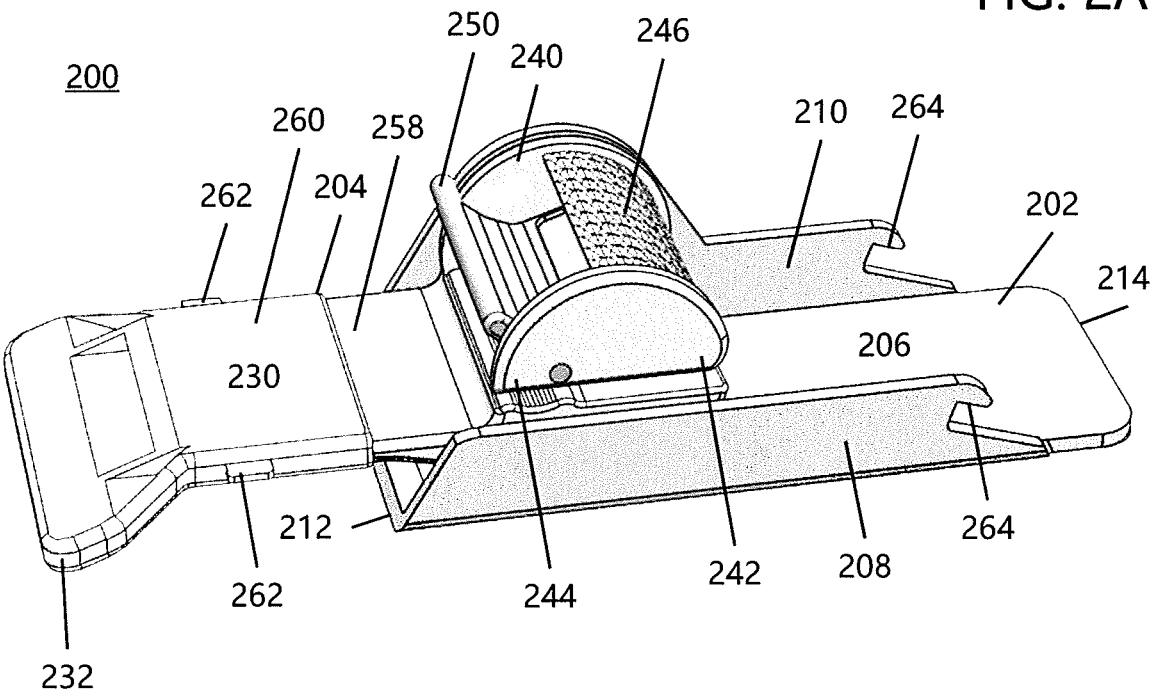
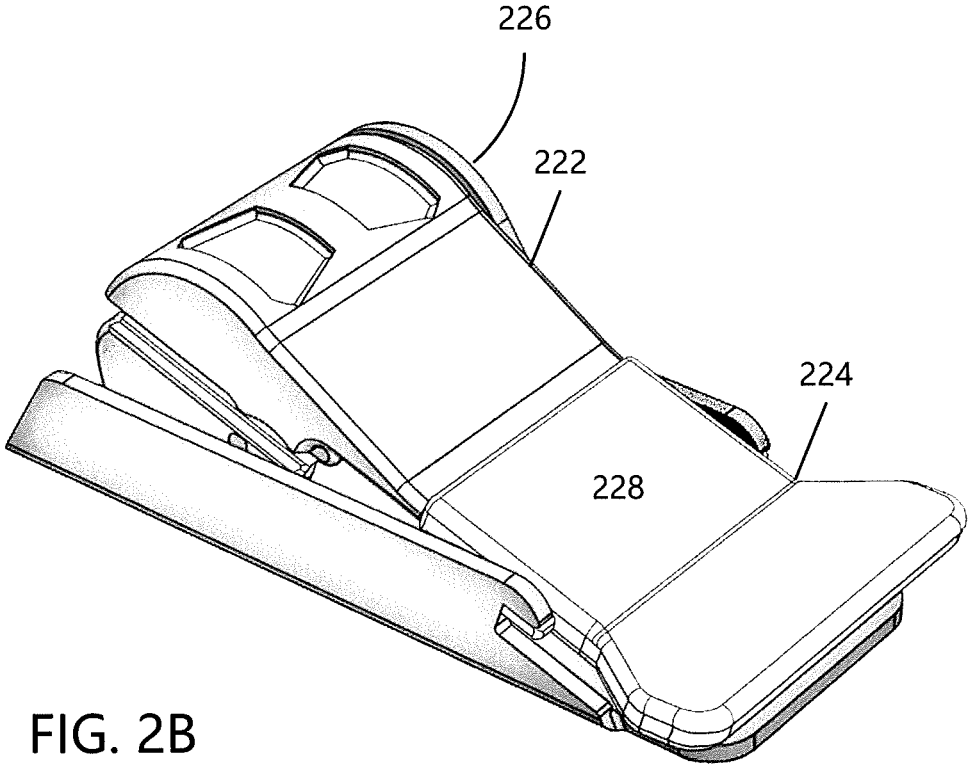
FIG. 2B

FIG. 4A
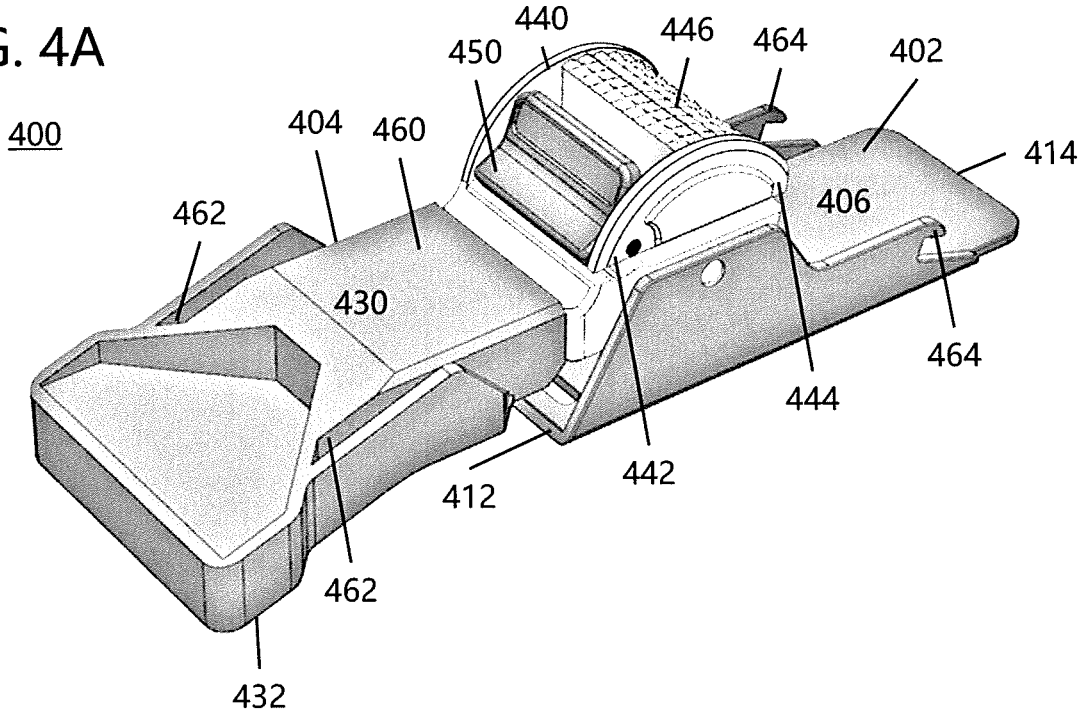
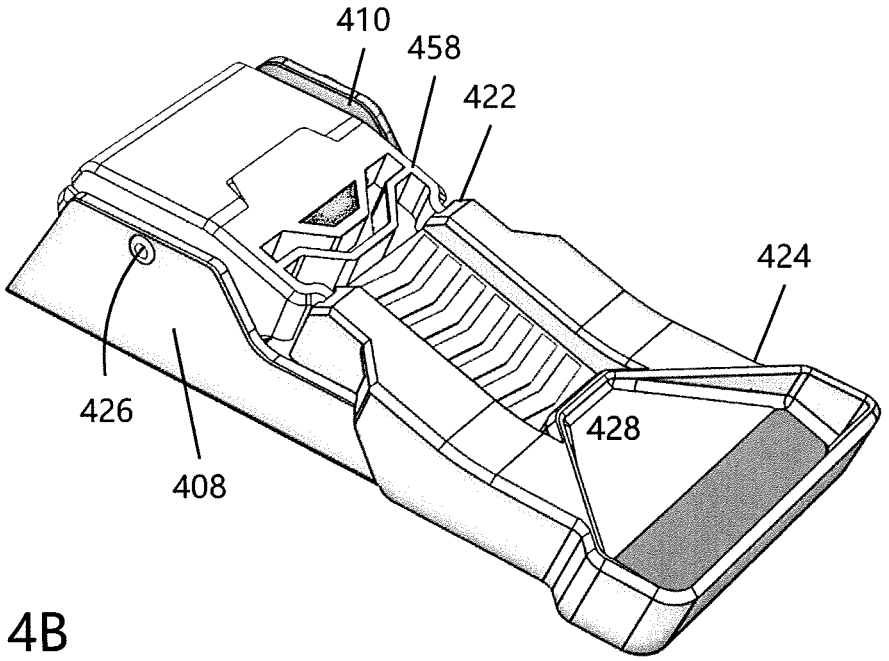
FIG. 4B

FIG. 5A
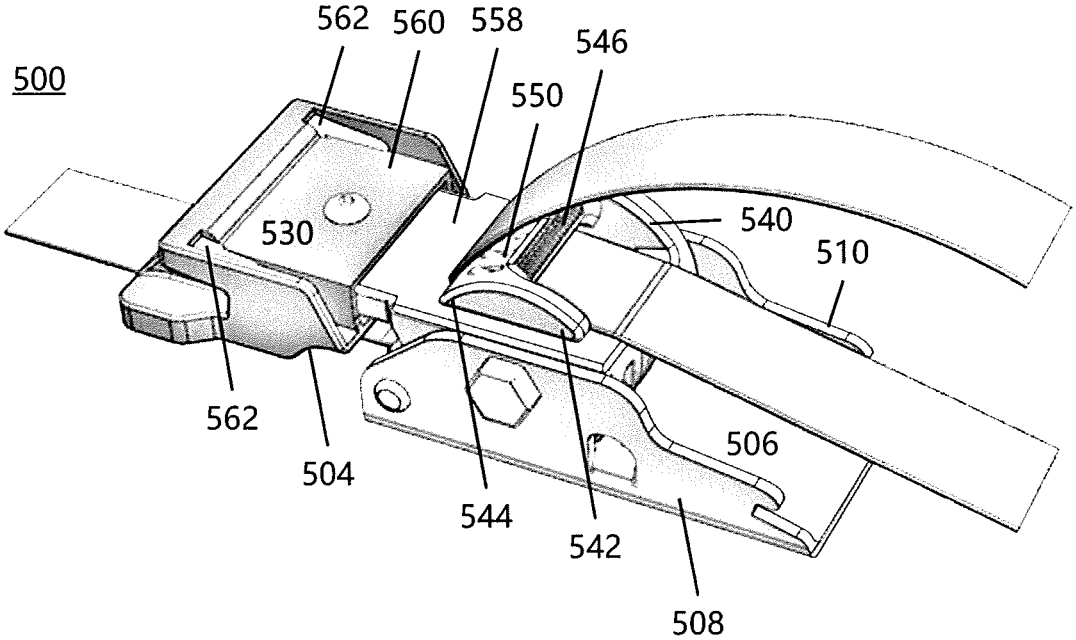
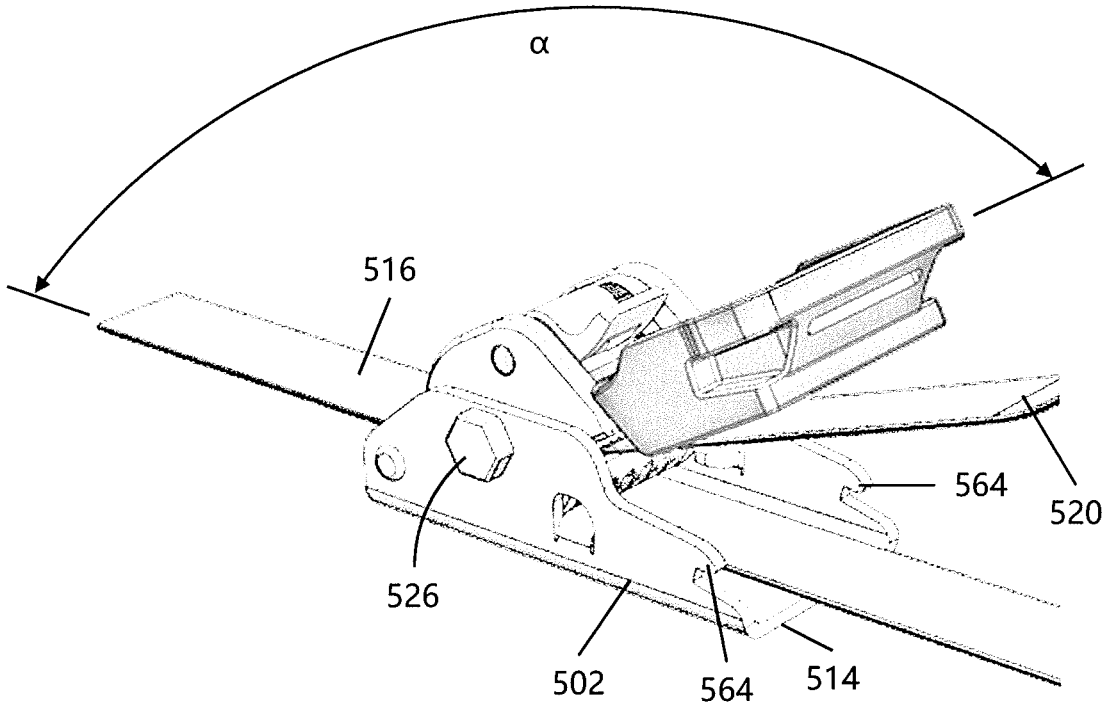
FIG. 5B

FIG. 5C
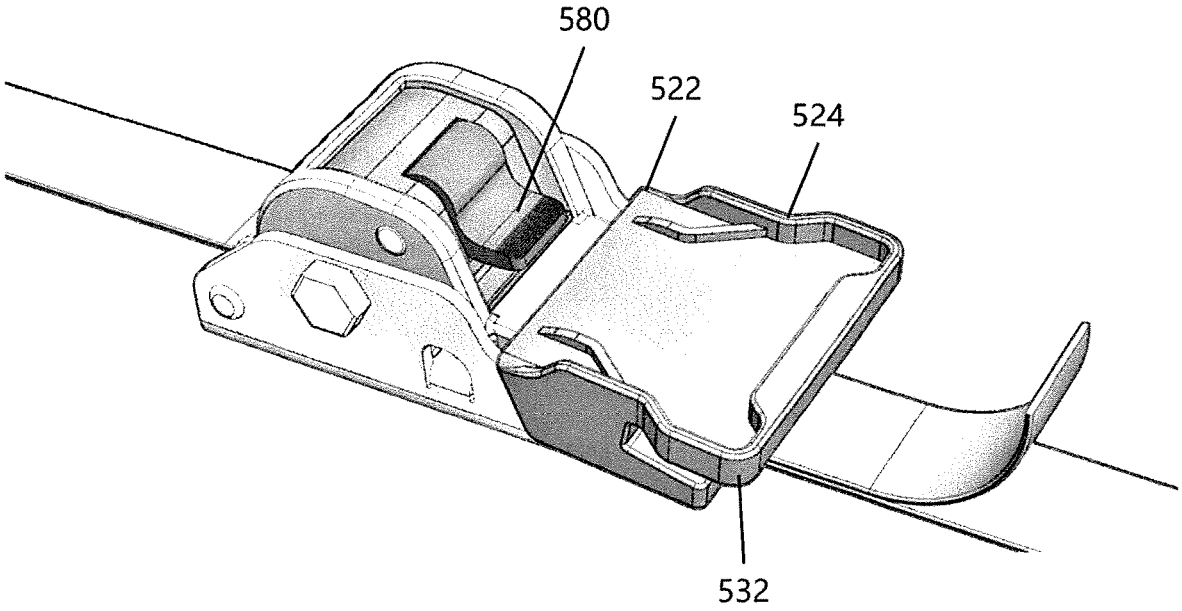
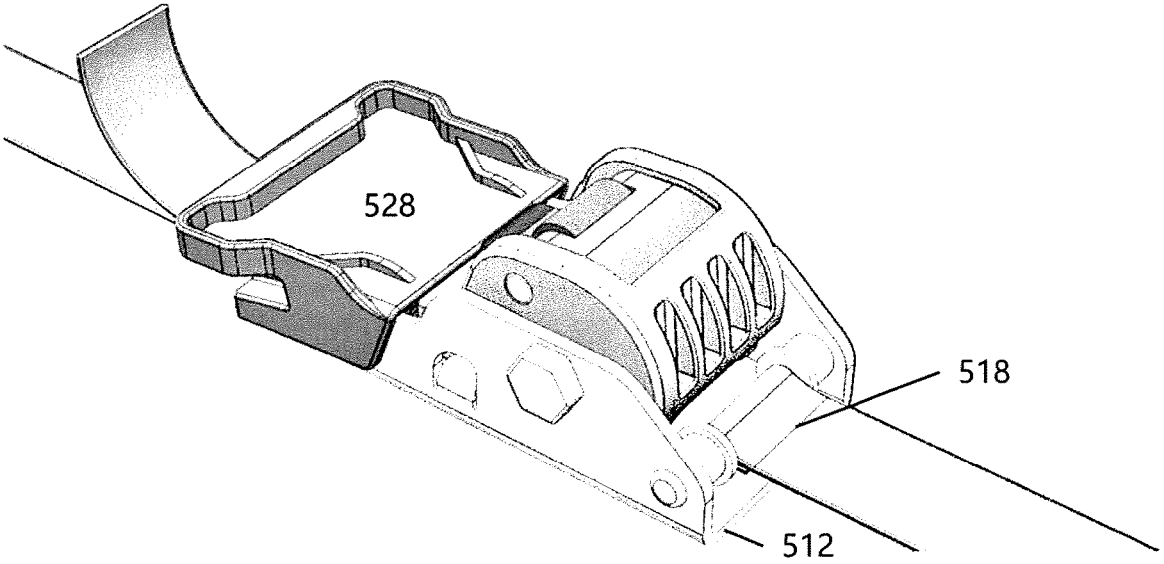
FIG. 5D

FIG. 6A
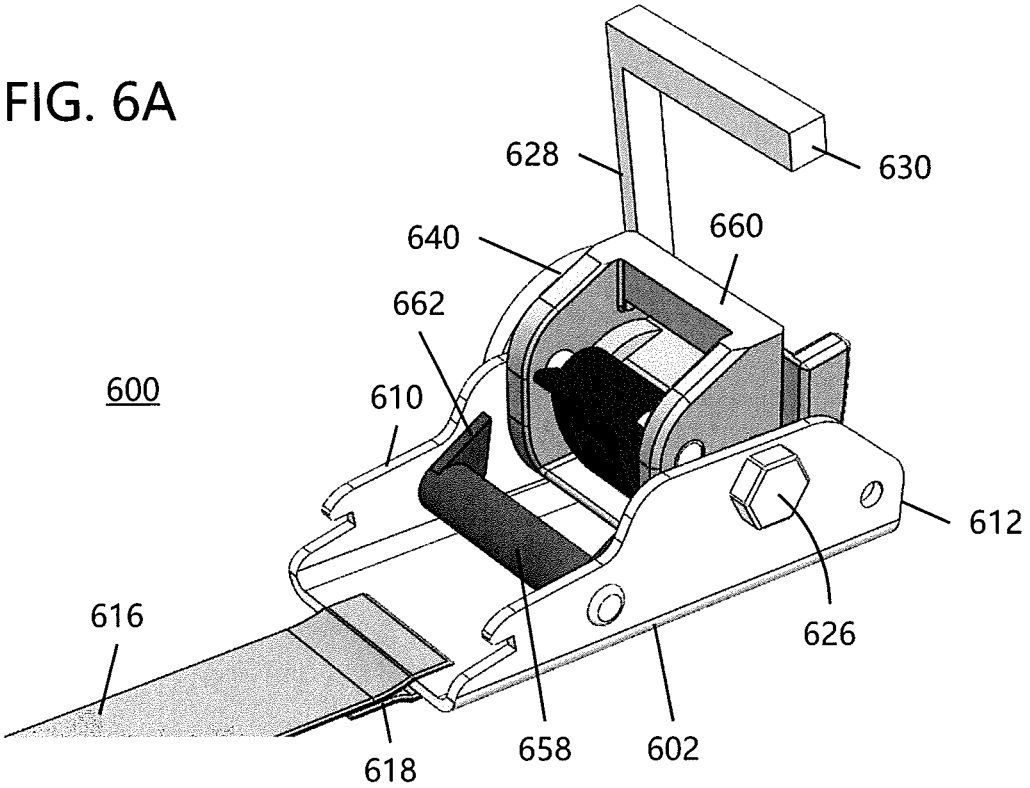
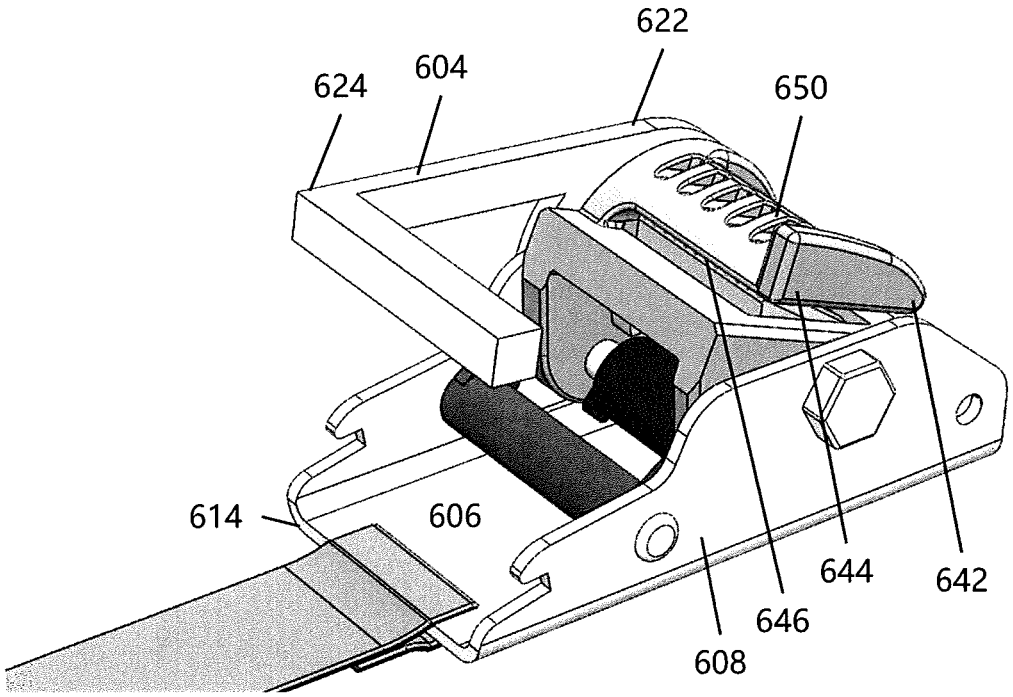
FIG. 6B

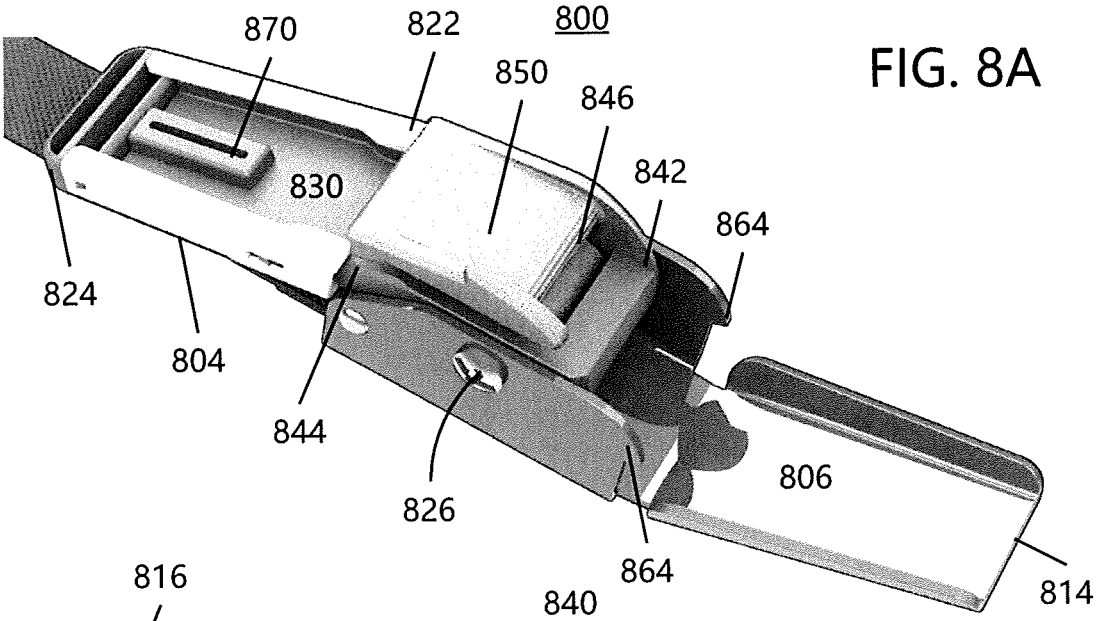
FIG. 8A
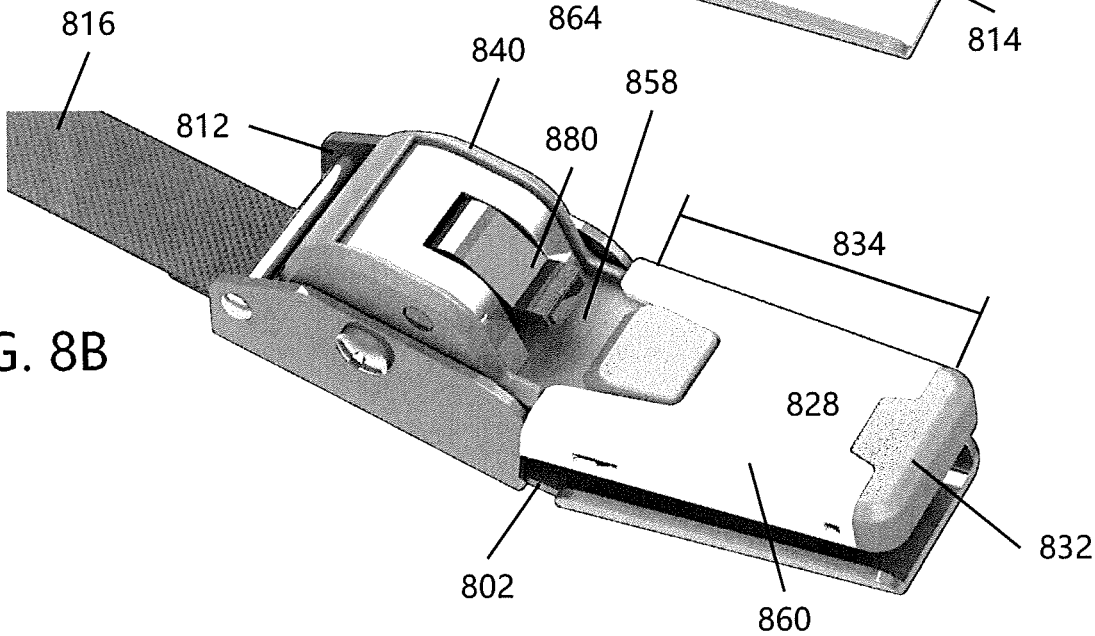
FIG. 8B
FIG. 8C
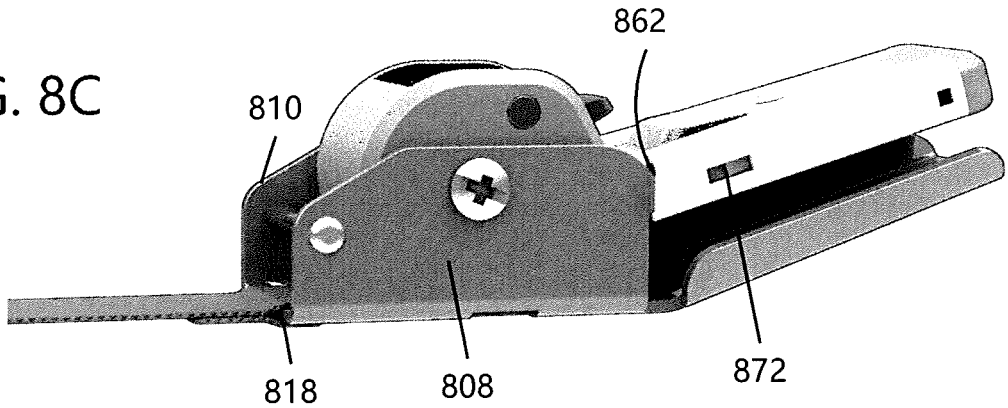

STRAP TIE-DOWN

CROSS REFERENCE TO RELATED APPLICATIONS

This application claims priority to U.S. Provisional Application No. 62/685,430 filed Jun. 15, 2018, the disclosure of which is herein incorporated by reference in its entirety.

BACKGROUND

The present disclosure relates to tie-down straps, particularly to an improved tie-down strap that includes a base, a lever arm, and an associated cam. The present disclosure can be used in securing loads of various shapes and sizes.

Common tie-down devices such as known cam straps will allow a strap to be pulled therethrough and an associated cam buckle will hold the strap in tension corresponding to the level of tightness a particular user can pull the strap. As such, based on the user, the strap tightness may be insufficient for a particular use.

Other known tie down-devices include ratchet straps. Ratchet straps enable a significant mechanical advantage to tightening the strap over hand-pull arrangements but are often complex and difficult for users to operate properly.

In view of the known devices discussed above, there remains a need for an improved tie-down strap that addresses the aforementioned problems.

BRIEF DESCRIPTION

The present disclosure is directed to a tie-down device that includes a base frame, a lever arm, a cam, and a locking mechanism. The base frame generally includes one or more sidewalls and is configured to receive a fixed end of an associated strap. The lever arm is generally pivotally supported on the one or more sidewalls of the base frame. The cam is located at one end of the lever arm and generally includes one or more engagement features that are configured to grab and/or engage a free end of the associated strap and to hold the associated strap in tension. The locking mechanism is configured to lock the base frame and lever arm together in a closed configuration and/or release the base frame and lever arm in an open configuration. The locking mechanism in the closed configuration is configured to maintain tension on the associated strap and the open configuration is configured to release tension on the associated strap.

In another non-limiting aspect of the present disclosure, the tie-down device can optionally include one or more surface features disposed on the lever arm and configured to enhance grip on the lever arm. The one or more surface features can optionally include a region of increased thickness, a chamfered edge, a taper, and/or a handle.

In another non-limiting aspect of the present disclosure, the one or more engagement features of the cam can optionally include a series of ridges, a textured surface, a knurled surface, and/or one or more walls.

In another non-limiting aspect of the present disclosure, the cam can optionally include a strap guide that is configured to align the associated strap with the one or more engagement features.

In another non-limiting aspect of the present disclosure, the associated strap can optionally be held in tension with one or more engagement features of the cam when the lever arm is positioned at an obtuse angle with respect to the base frame.

In another non-limiting aspect of the present disclosure, the one or more engagement features of the cam can optionally be configured to grab the free end of the associated strap when the lever arm is positioned at an angle of about 100-170° (and all values and ranges therebetween) with respect to the base frame, and generally at an angle of 120-140° with respect to the base frame.

In another non-limiting aspect of the present disclosure, the one or more engagement features of the cam can optionally be configured to increase tension in the associate strap when the lever arm is positioned at an angle of about 105-200° (and all values and ranges therebetween) with respect to the base frame, and generally at an angle of 120-180° with respect to the base frame.

In another non-limiting aspect of the present disclosure, the one or more engagement features of the cam can optionally be configured to pull the associated strap a distance of greater than 0 inches to about 3 inches (and all values and ranges therebetween) when the lever arm is positioned at an angle of about 105-200° (and all values and ranges therebetween) with respect to the base frame, and generally at an angle of 120-180° with respect to the base frame.

In another non-limiting aspect of the present disclosure, the locking mechanism further optionally includes one or more resiliently-biased tabs disposed on the one or more sidewalls of the base frame.

In another non-limiting aspect of the present disclosure, the locking mechanism optionally includes one or more substantially flat stop walls disposed on the cam.

In another non-limiting aspect of the present disclosure, the locking mechanism optionally includes a friction bar supported between the one or more sidewalls of the base frame.

In another non-limiting aspect of the present disclosure, the locking mechanism optionally includes a push tab disposed on the lever arm and one or more recesses disposed on the one or more sidewalls of the base frame which are configured to receive the push tab.

In another non-limiting aspect of the present disclosure, the locking mechanism optionally includes a sliding handle disposed on the lever arm that is configured to engage one or more notches disposed on the one or more sidewalls of the base frame. The sliding handle optionally includes one or more flanges or one or more recesses configured to engage with the one or more notches.

In another non-limiting aspect of the present disclosure, the tie-down device optionally includes a biasing member that is configured to automatically move the sliding handle into engagement with the one or more notches.

In another non-limiting aspect of the present disclosure, the tie-down device optionally includes a restrictor mechanism that is configured to limit movement of the sliding handle against the biasing member.

In another non-limiting aspect of the present disclosure, the tie-down device optionally includes a release switch that is configured to adjust tension in the associated strap.

In another non-limiting aspect of the present disclosure, there is provided a method for using a tie-down device that includes a) providing a base frame including one or more sidewalls and configured to receive a fixed end of an associated strap, a lever arm pivotally supported on the one or more sidewalls of the base frame, a cam located at one end of the lever arm and including one or more engagement features configured to grab a free end of the associated strap and hold the associated strap in tension, and a locking mechanism configured to lock the base frame and lever arm together in a closed configuration or release the base frame and lever arm in an open configuration; b) inserting the free end of the associated strap into the cam; c) rotating the lever arm until an angle of at least 100° is formed with respect to the base frame, thereby grabbing the associated strap with the one or more engagement features of the cam; d) rotating the lever arm until an angle of at least about 105° is formed with respect to the base frame, thereby increasing a tension in the associated strap with the one or more engagement features; and, e) locking the base frame and lever arm together with the locking mechanism to maintain the tension in the associated strap.

In another non-limiting aspect of the present disclosure, there is provided a tie-down device that includes a) a base frame including one or more sidewalls; b) an associated strap including a fixed end attached to the base frame and a free end; c) a lever arm supported on the one or more sidewalls of the base frame by a pivot pin and including a first end and a second end; d) a cam located at the first end of the lever arm including one or more engagement features configured to grab the free end of the associated strap when the lever arm is positioned at an angle of at least 100° with respect to the base frame and increase tension in the associated strap when the lever arm is positioned at an angle of at least 105° with respect to the base frame; e) one or more surface features disposed on the second end of the lever arm and configured to enhance grip on the lever arm; and, f) a locking mechanism configured to lock the base frame and lever arm together in a closed configuration and maintain tension in the associated strap or release the base frame and lever arm in an open configuration and release tension in the associated strap, and wherein the locking mechanism includes one or more resiliently-biased tabs, one or more substantially flat stop walls, a friction bar, a push tab, and/or a sliding handle.

One non-limiting object of the present disclosure is to provide an improved tie-down device. The device includes a base frame with one or more sidewalls and configured to receive a fixed end of an associated strap. A lever arm is pivotally supported on the one or more sidewalls of the base frame. A cam is located at one end of the lever arm and includes one or more engagement features configured to grab a free end of the associated strap and hold the associated strap in tension. A locking mechanism is configured to lock the base frame and lever arm together in a closed configuration or release the base frame and lever arm in an open configuration. The closed configuration maintains tension in the associated strap and the open configuration releases tension in the associated strap.

Another and/or alternative non-limiting object of the present disclosure is that the improved tie-down device includes one or more surface features disposed on the lever arm. The surface features are configured to enhance grip on the lever arm. The one or more surface features can include a region of increased thickness, a chamfered edge, a taper, and/or a handle.

Still another and/or alternative non-limiting object of the present disclosure is that the one or more engagement features of the improved tie-down device include a series of ridges, a textured surface, a knurled surface, and/or one or more walls.

Another and/or alternative non-limiting object of the present disclosure is that the improved tie-down device includes a strap guide configured align the associated strap with the one or more engagement features.

Still another and/or alternative non-limiting object of the present disclosure is that the associated strap of the improved tie-down device is held in tension with one or more engagement features of the cam when the lever arm is positioned at an obtuse angle with respect to the base frame.

Another and/or alternative non-limiting object of the present disclosure is that the one or more engagement features of the cam of the of the improved tie-down device are configured to grab the free end of the associated strap when the lever arm is positioned at an angle of about 120-140°, including about 130°, with respect to the base frame.

Another and/or alternative non-limiting object of the present disclosure is that the one or more engagement features of the cam of the of the improved tie-down device are configured to increase tension in the associate strap when the lever arm is positioned at an angle of about 130-180° with respect to the base frame.

Another and/or alternative non-limiting object of the present disclosure is that the one or more engagement features of the cam of the of the improved tie-down device are configured to pull the associated strap a distance of 0-3 inches, and typically 0-1 inch when the lever arm is positioned at an angle of about 130-180° with respect to the base frame.

Still another and/or alternative non-limiting object of the present disclosure is that the locking mechanism of the improved tie-down device further includes one or more resiliently-biased tabs disposed on the one or more sidewalls of the base frame.

Still another and/or alternative non-limiting object of the present disclosure is that the locking mechanism of the improved tie-down device further includes one or more substantially flat stop walls disposed on the cam.

Still another and/or alternative non-limiting object of the present disclosure is that the locking mechanism of the improved tie-down device further includes a friction bar supported between the one or more sidewalls of the base frame.

Still another and/or alternative non-limiting object of the present disclosure is that the locking mechanism of the improved tie-down device further includes a push tab disposed on the lever arm and one or more recesses disposed on the one or more sidewalls of the base frame and configured to receive the push tab.

Still another and/or alternative non-limiting object of the present disclosure is that the locking mechanism of the improved tie-down device further includes a sliding handle disposed on the lever arm and configured to engage one or more notches disposed on the one or more sidewalls of the base frame. The sliding handle can further include one or more flanges or one or more recesses configured to engage with the one or more notches. A biasing member can optionally be used and is configured to automatically move the sliding handle into engagement with the one or more notches can also be included. In addition, a restrictor mechanism can optionally be used and is configured to limit movement of the sliding handle against the biasing member could be included.

Another and/or alternative non-limiting object of the present disclosure is that the improved tie-down device further includes a release switch configured to adjust tension in the associated strap.

Another and/or alternative non-limiting object of the present disclosure is to provide an improved method for using tie-down device. The method includes providing: a base frame including one or more sidewalls and configured to receive a fixed end of an associated strap, a lever arm pivotally supported on the one or more sidewalls of the base frame, a cam located at one end of the lever arm and including one or more engagement features configured to grab a free end of the associated strap and hold the associated strap in tension, and a locking mechanism configured to lock the base frame and lever arm together in a closed configuration or release the base frame and lever arm in an open configuration. The method further includes inserting the free end of the associated strap into the cam. The method goes on to include rotating the lever arm until an angle of about 100-160° is formed with respect to the base frame, thereby grabbing the associated strap with the one or more engagement features of the cam. Additionally, the method includes rotating the lever arm until an angle of about 105-200° is formed with respect to the base frame, thereby increasing a tension in the associated strap with the one or more engagement features. Finally, the method includes locking the base frame and lever arm together with the locking mechanism to maintain the tension in the associated strap.

Another and/or alternative non-limiting object of the present disclosure is to provide an improved tie-down device which includes a base frame having one or more sidewalls. An associated strap is included which has a fixed end attached to the base frame and a free end. A lever arm is supported on the one or more sidewalls of the base frame by a pivot pin and includes a first end and a second end. A cam is located at the first end of the lever arm and includes one or more engagement features configured to grab the free end of the associated strap when the lever arm is positioned at an angle of about 100-160° with respect to the base frame and increase tension in the associated strap when the lever arm is positioned at an angle of about 105-200° with respect to the base frame. One or more surface features are disposed on the second end of the lever arm and are configured to enhance grip on the lever arm. A locking mechanism is also included which is configured to lock the base frame and lever arm together in a closed configuration and maintain tension in the associated strap or release the base frame and lever arm in an open configuration and release tension in the associated strap. The locking mechanism includes one or more resiliently-biased tabs, one or more substantially flat stop walls, a friction bar, a push tab, and/or a sliding handle.

These and other objects and advantages will become apparent from the discussion of the distinction between the disclosure and the prior art and when considering the preferred embodiment shown in the accompanying drawings.

BRIEF DESCRIPTION OF THE DRAWINGS

Reference may now be made to the drawings, which illustrate various embodiments that the disclosure may take in physical form and in certain parts and arrangement of parts wherein:

FIG. 2A is an illustration according to another non-limiting embodiment of the present disclosure showing an improved tie-down device in an open configuration and which includes a two-part lever arm for locking the device;

FIG. 2B is an illustration showing the improved tie-down device of FIG. 2A in a closed configuration;

FIG. 4A is an illustration according to another non-limiting embodiment of the present disclosure showing an improved tie-down device in an open configuration and which includes a two-part lever arm for locking the device;

FIG. 4B is an illustration showing the improved tie-down device of FIG. 4A in a closed configuration;

FIG. 5A is an illustration according to another non-limiting embodiment of the present disclosure showing an improved tie-down device in an open configuration and which includes a two-part lever arm for locking the device;

FIG. 5B is an illustration showing the improved tie-down device of FIG. 5A in a partially closed configuration and an angle of engagement a for a cam;

FIG. 5C is an illustration showing the improved tie-down device of FIG. 5A in a closed configuration;

FIG. 5D is an illustration showing the improved tie-down device of FIG. 5A in a closed configuration and a fixed end of an associated strap attached to a base of the device;

FIG. 6A is an illustration according to an additional non-limiting embodiment of the present disclosure showing an improved tie-down device in an open configuration and which includes a friction bar for locking the device;

FIG. 6B is an illustration showing the improved tie-down device of FIG. 6A in a closed configuration;

FIG. 8A is an illustration according to another non-limiting embodiment of the present disclosure showing an improved tie-down device in an open configuration and which includes a spring-biased two-part lever arm for locking the device;

FIG. 8B is an illustration showing the improved tie-down device of FIG. 8A in a closed configuration which includes an optional release switch; and, FIG. 8C is an illustration showing the improved tie-down device of FIG. 7A in a closed configuration and a fixed end of an associated strap attached to a base of the device.

DETAILED DESCRIPTION

Figure 1A:
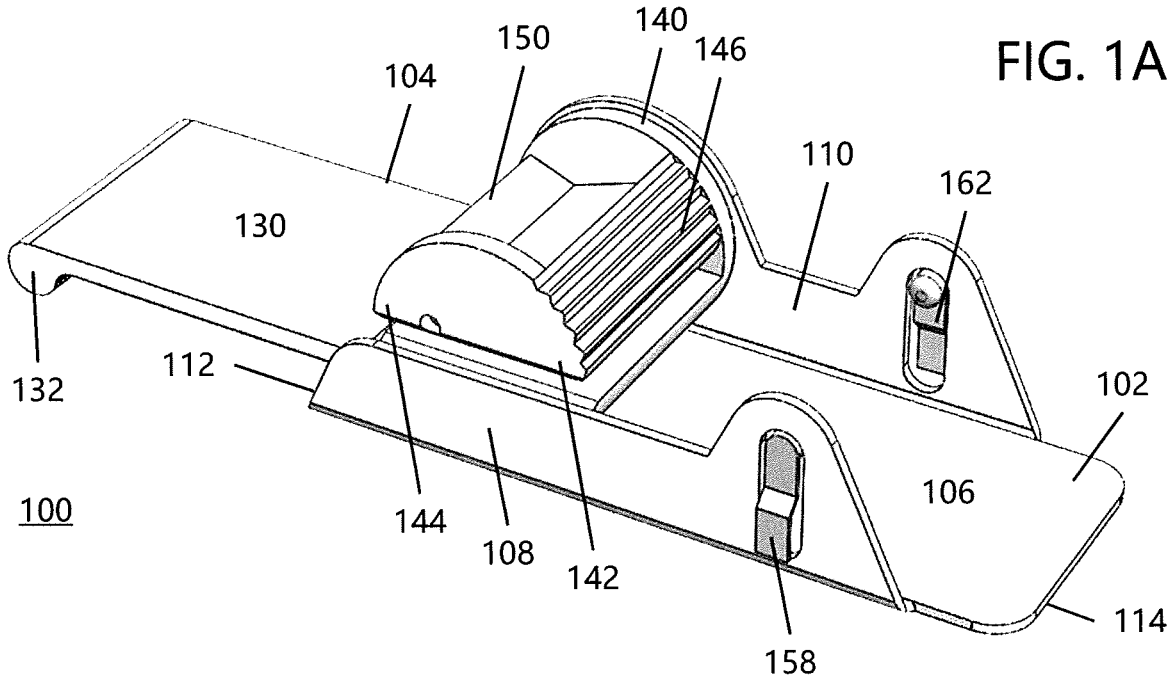
FIG. 1A is an illustration according to one non-limiting embodiment of the present disclosure showing an improved tie-down device in an open configuration and which includes one or more resiliently-biased tab members for locking the device.

In the following description, for purposes of explanation, numerous specific details are set forth in order to provide a thorough understanding of the present disclosure. It will be apparent, however, to one skilled in the art that the present disclosure can be practiced without these specific details.

Reference in this specification to "one embodiment" or "an embodiment" means that a particular feature, structure, or characteristic described in connection with the embodiment is included in at least one representation of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced item. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient, but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

Referring now to the drawings, wherein the showings are for the purpose of illustrating non-limiting embodiments of the disclosure only and not for the purpose of limiting the same, FIGS. 1-8 illustrate various aspects of a strap tie-down device in accordance with the present disclosure.

Referring now to FIGS. 1-8, there is illustrated an improved strap tie-down device according to non-limiting embodiments of the present disclosure. More particularly, FIGS. 1A-1B illustrate tie-down device 100, FIGS. 2A-2B illustrate tie-down device 200, FIGS. 3A-3B illustrate tie-down device 300, FIGS. 4A-4B illustrate tie-down device 400, FIGS. 5A-5D illustrate tie-down device 500, FIGS. 6A-6B illustrate tie-down device 600, FIGS. 7A-7C illustrate tie-down device 700, and FIGS. 8A-8C illustrate tie-down device 800. Each tie-down device (100, 200, 300, 400, 500, 600, 700, and 800) generally comprises two primary components, namely a base frame (102, 202, 302, 402, 502, 602, 702, and 802, respectively) and a lever arm (104, 204, 304, 404, 504, 604, 704, and 804, respectively); however, such a configuration is non-limiting.

The base frames generally have a U-shaped profile that is defined by a base surface (106, 206, 306, 406, 506, 606, 706, and 806, respectively), a first sidewall (108, 208, 308, 408, 508, 608, 708, and 808, respectively) extending upwardly from the base surface, and a second sidewall (110, 210, 310, 410, 510, 610, 710, and 810, respectively) extending upwardly from the base surface, where each base surface generally spans 60-100% (and all values and ranges therebetween) between the first and second sidewalls, and typically 90-100% between the first and second sidewalls. As can be appreciated, the base frames can have a profile other than a U-shaped profile. The average height of the first and second sidewalls extending upwardly from the base surface, and a second sidewalls is generally at least two times the thickness of the strap.

A length of each base is generally defined between a first end (112, 212, 312, 412, 512, 612, 712, and 812, respectively) and a second end (114, 214, 314, 414, 514, 614, 714, and 814, respectively), where the first end of the base is generally configured to receive a fixed end (shown in FIGS. 5D, 6A, 7C, and 8C as 518, 618, 718, and 818, respectively) of an associated strap or web (shown in FIGS. 5B, 6A, 7B, and 8B as 516, 616, 716, and 816, respectively) and the second end of the base is generally configured to receive a free end of the associated strap (shown in FIG. 5B as 518); however, such a configuration is non-limiting. Typically, the fixed end of the associated strap is attached or otherwise connected to one end of each base, such as by use of a closed loop, for example. However, such a configuration is non-limiting. Generally, the fixed end of the associated strap is connected to the base such that it is immoveable from and/or relative to the base during the tightening of the strap. One or both of the first and second sidewalls are configured to support the lever arm that is positioned adjacent the first end of each base.

Each lever arm also generally comprises a first end (122, 222, 322, 422, 522, 622, 722, and 822, respectively) and a second end (124, 224, 324, 424, 524, 624, 724, and 824, respectively). The length of each lever arm is generally the distance between the first and second ends; however, this is not required. The support for the lever arm on the first and/or second sidewall is adapted to provide a pivot point (126, 226, 326, 426, 526, 626, 726, and 826, respectively), such as by, but not limited to, use of a transverse pivot pin, for example. The pivot point defines an axis about which the lever arm can rotate relative to the base.

Figure 1B:
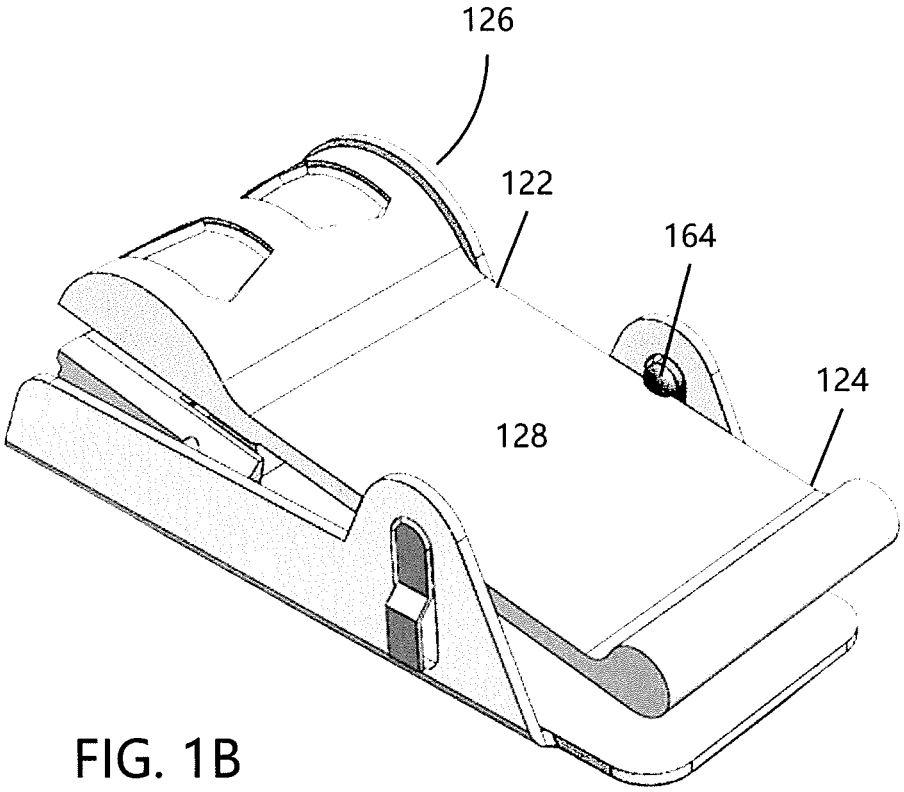
FIG. 1B is an illustration showing the improved tie-down device of FIG. 1A in a closed configuration.

Each lever arm (104, 204, 404, 504, 704, and 804) in FIGS. 1A-1B, 2A-2B, 4A-4B, 5A-5D, 7A-7C, and 8A-8C, respectively, is generally rectangular in shape and includes a top or upper handle surface (128, 228, 428, 528, 728, and 828) and an opposing bottom or lower handle surface (130, 230, 430, 530, 730, and 830). As can be appreciated, the lever arm can have a shape other than a rectangular shape. The rectangular shape, upper handle surface, and lower handle surface of each lever arm (104, 204, 404, 504, 704, and 804) are adapted to provide a large surface area which permits a user to easily engage the lever arm during use of the tie-down device; however, such a configuration is non-limiting. In addition, one or more surface features (132, 232, 432, 532, 732, and 832) located adjacent the second end of each lever arm is configured to further enhance the grip of the lever by a user of the tie-down device. As illustrated in FIGS. 1A and 1B, the surface feature 132 includes an increased thickness region that is generally cylindrical in shape and/or has a rounded non-sharp shape. As illustrated in FIGS. 2A-2B, 4A-4B, and 5A-5D, the surface features 232, 432, and 532 include an increased width region that is generally trapezoidal in shape; however, other shapes can be used. As illustrated in FIGS. 7A-7D and 8A-8D, the surface features 732 and 832 include a chamfered edge along the sides of the lever arm; however, such a configuration is non-limiting. FIGS. 7A-7D and 8A-8D also illustrate surface features 734 and 834 which include an edge which tapers from the first end of the lever arm to the second end such that the lever arm gradually reduces in width. The tapered edges 734, 834 are generally configured to enhance the grip of the lever by a user. However, such a configuration is non-limiting. The surface features are generally located only a portion of the lever arm. Typically, the surface features are located only along 5-40% of the longitudinal length of the lever arm (and all values and ranges therebetween).

Lever arms 304 and 604 in FIGS. 3A-3B and 6A-6B, respectively, generally include an elongated or vertical portion 328 and 628 and a handle 330 and 630 disposed at an angle (e.g., 70-120°, 90°, etc.) to the elongated portion. The elongated portion and handle of lever arms 304 and 604 are also adapted to permit a user to easily engage the lever arm during use of the tie-down device; however, such a configuration is non-limiting.

The first ends of the lever arms illustrated in the embodiments of FIGS. 1-8 include a cam (140, 240, 340, 440, 540, 640, 740, and 840, respectively) adapted to trap and release a portion of the associated strap (e.g., flexible strap). In this regard, a first end (142, 242, 442, 542, 642, 742, and 842)

of cams 140, 240, 440, 540, 640, 740, and 840 generally includes one or more engagement features configured to grab and trap the associated strap between the cam and base. As illustrated in FIGS. 1A-1B, 5A-5D, 7A-7C, and 8A-8C, the one or more engagement features include a plurality of ridges (146, 546, 746, and 846, respectively) configured to engage the associated strap; however, such a configuration is non-limiting. As illustrated in FIGS. 2A-2B, 4A-4B, and 6A-6B, the one or more engagement features includes a textured or knurled surface (246, 446, 646, respectively) configured to engage the associated strap; however, such a configuration is non-limiting. Generally, the engagement features are a non-smooth surface (e.g., ridges, textured surface, ribs, raised bumped regions, sharp raised regions, etc.).

Adjacent a second end (144, 244, 444, 544, 644, 744, and 844) of cams 140, 240, 440, 540, 640, 740, and 840 is a strap guide or guide wall (150, 250, 450, 550, 650, 750, and 850) generally configured to position the associated strap in alignment with the one or more engagement features, thereby ensuring the one or more engagement features can adequately grab and trap the associated strap. Typically, the free end portion of the associated strap is wrapped around and pulled against the strap guide or guide wall to manually add tension to the strap. The guide wall is generally positioned between the two side walls of the cam. Generally, the spacing between the side walls of the cam is greater than a width of the strap such that the strap is positioned between the cam sidewalls when the free end portion of the associated strap is wrapped around and pulled against the strap guide or guide wall.

Figure 3A:
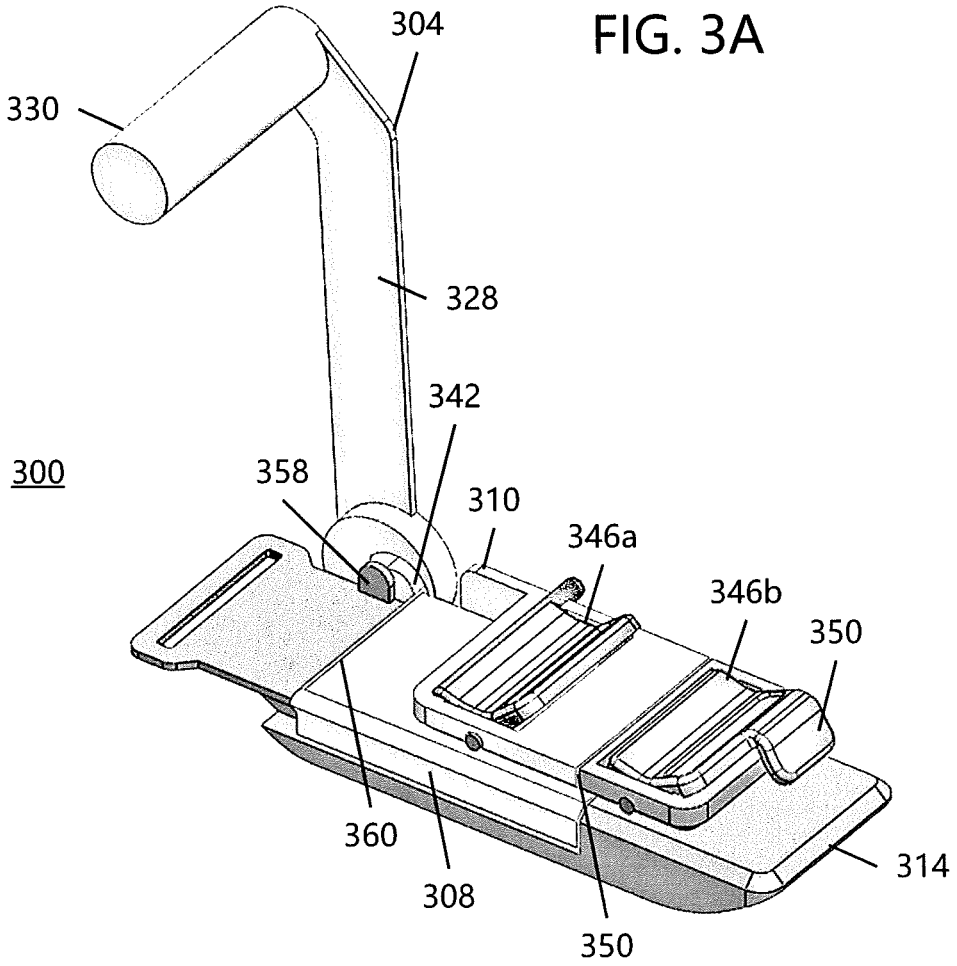
FIG. 3A is an illustration according to an additional non-limiting embodiment of the present disclosure showing an improved tie-down device in an open configuration and which includes one or more stop walls on a rotating cam for locking the device.
Figure 3B:
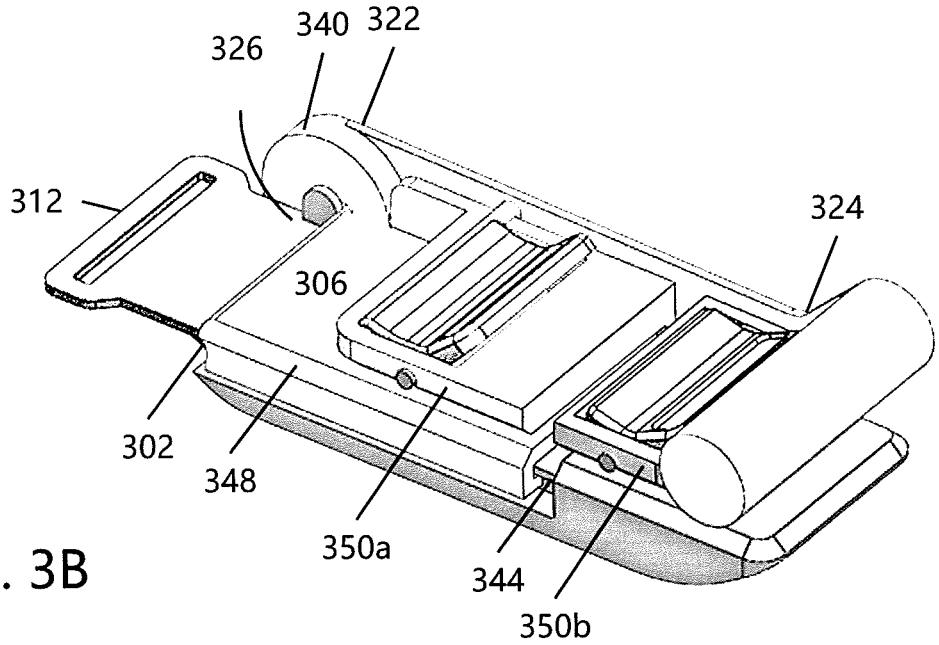
FIG. 3B is an illustration showing the improved tie-down device of FIG. 3A in a closed configuration.

Regarding the tie-down device 300 illustrated in FIGS. 3A-3B, the cam 340 is comprised of two primary components, including a rotating portion 342 and a linear sliding portion 344. However, such a configuration is non-limiting. The sliding cam portion 344 comprises a part of the base 302 and base surface 306 and is configured to fit within and optionally under the first and second sidewalls 308, 310. In other words, the interface between the first and second sidewalls 308, 310 and the sliding cam portion 344 is a sliding track. A remaining base portion 348 generally remains stationary with respect to sliding cam portion 344. The one or more engagement features of cam 340 includes one or more strap walls 346*a* and 346*b* configured to engage the associated strap, with strap walls being split between a two-part strap guide wall 350. The two-part guide wall 350 includes a stationary portion 350*a*, which includes strap wall 346*a* and is disposed on stationary base portion 348, and a moving portion 350*a*, which includes strap wall 346*b* that moves with the sliding cam portion 344. In particular, the free end of the associated strap can be wrapped around both guide wall portions 350*a*, 350*b* and under/over the one or more strap walls 346*a* and 346*b* to manually add tension to the strap. The one or more strap walls 346*a*, 346*b* are optionally pivotable with respect to guide walls 350*a*, 350*b* to facilitate wrapping of the associated strap. However, such a configuration is non-limiting. The guide walls 350*a* and 350*b* are generally configured to position the associated strap in alignment with the one or more engagement features (i.e., strap walls 346*a* and 346*b*), thereby ensuring the one or more engagement features can adequately grab and trap the associated strap. An additional tooth 352 can be included on strap wall 346*b* as an additional guide wall to ensure proper alignment and engagement with the associated strap.

The base frame, lever arm, and cam of the tie-down devices in the present disclosure are configured to work symbiotically with an associated flexible strap or webbing. When the base frame, lever arm, and cam of each tie-down device are assembled, the first end of each lever arm can pivot in radial relation to each base surface. In this regard, each lever arm can pivot between an open configuration as illustrated in FIGS. 1A, 2A, 3A, 4A, 5A, 6A, 7A, and 8A, and a closed configuration as illustrated in FIGS. 1B, 2B, 3B, 4B, 5C-5D, 6B, 7B-7C, and 8B-8C. In the closed configuration of FIGS. 1B, 2B, 3B, 4B, 5C-5D, 6B, 7B-7C, and 8B-8C, each lever arm has rotated such that the bottom surface of the lever arm and the base surface of the base are approximately parallel to one another. However, such a configuration is non-limiting. The closed configuration of each tie-down device can generally be maintained by a latch or locking mechanism disposed on one or both of each base (e.g., first and second sidewalls and/or base surface of the base) and latch arm. The locking mechanism is configured to engage portions of each base frame and/or lever arm, thereby locking the two components together as discussed in further detail below.

During use of each tie-down device 100-800, tension is manually applied to the free end of the associated strap as discussed above, until the strap exerts a sufficient securing force against an associated load. The second end of the lever arm is then pivoted toward the base, from the open configuration to the closed configuration. As the lever arm pivots, the one or more engagement features of the cam grabs the strap. In the embodiments illustrated in FIGS. 1-8, the one or more engagement features of the cam grabs the strap when the lever arm has been rotated into a position referred to as the angle of engagement a with respect to the base. As shown in FIG. 5B, angle of engagement a is defined as the obtuse angle between the between base frame and the cam lever, with the pivot point (e.g., 526) being the vertex. In specific embodiments, the angle of engagement a can be from about 120-140°, including approximately 130°, thereby maintaining the tension in the strap. Continued rotation of the lever arm past the angle of engagement a causes the one or more engagement features of the cam to continue pulling the strap, thereby further increasing tension in the strap. In some embodiments, continued rotation of the lever arm past angle $\alpha$, including angles from about 130-180°, will further increase tension in the associated strap. In some particular embodiments of the present disclosure, the cam and its one or more engagement features, with continued rotation of the lever arm to the approximate 130-180° position, are configured to pull the strap a distance of approximately 0-1 inch, including about 0.25 inches and about 0.5 inches. However, such a configuration is non-limiting.

With specific reference to the tie-down device 300 illustrated in FIGS. 3A-3B, pivoting of the lever arm past the angle of engagement a causes the sliding cam portion 344 to move in a direction away from the first end 312. The guide wall 350*b* and the strap wall 346*b* move with the sliding cam portion 344 while the guide wall 350*a* and strap wall 346*a* remain stationary. As a result, increased tension as described above is applied to the associated strap.

The lever arm of each tie-down device 100-800 is rotated until the locking mechanism is engaged, thereby latching the lever arm shut against the base and maintaining the tension in the strap, including both the tension applied to the strap manually and the tension applied to the strap by rotating the lever arm and cam. In order to release the tension in the strap, the locking mechanism is disabled such that the second end of the lever arm can be manually pivoted back toward the open configuration of each tie-down device. As the lever arm rotates away from the closed configuration, the one or more engagement features of the cam begin to disengage from the strap. Eventually, with continued rotation of the lever arm back toward the open configuration, the associated strap is able to slide freely away from the one or more engagement features of the cam.

As illustrated in FIGS. 1A and 1B, the locking mechanism includes a first and second resiliently-biased tab 158, 162 located on first and second sidewalls 108, 110, respectively. However, such a configuration is non-limiting. The resiliently-biased tabs include a knob portion (only knob 164 on tab 162 is shown) configured to push the tabs outward when the bottom surface of the lever arm 104 contacts the knobs as the lever arm is rotated about the pivot point 126 toward the fully closed configuration. Once the lever arm is in the fully closed configuration of FIG. 1B, the resiliently-biased tabs retract inward such that the knobs are positioned against the top surface of the lever arm, thereby locking the lever arm with respect to the base 102 and maintaining the tension in the strap. In order to unlock the lever arm and base and to release the tension in the strap, the second end of the lever arm 104 is manually pivoted back away from the base with enough force to overcome the resiliently-biased tabs. With enough force, the resiliently-biased tabs push outward to release the lever arm. Alternatively or additionally, the bottom outside portion of the tabs can be pushed by a user such that the bottom portion of the tab is caused to be moved toward the sidewall, which thereby causes the upper portion of the tab and knob portion to move such that the end of the knob moves toward the inner surface of the sidewall thereby enabling the lever arm to disengage or be released form the knobs. As the lever arm 104 rotates away, the one or more engagement features 146 of the cam 140 begin to disengage from the strap. Eventually, with continued rotation of the lever arm back toward the open configuration, the associated strap is able to slide freely away from the one or more engagement features of the cam.

As illustrated in FIGS. 2A and 2B, the locking mechanism of tie-down device 200 includes a two-part lever arm. That is, the lever arm is comprised of a stationary lever arm portion 258 and a sliding lever arm portion or handle 260. The sliding handle 260 is configured to fit around an exterior surface of the stationary lever arm portion 258 and to slide back and forth thereon. In such an embodiment, the enhanced engagement surface feature of the lever arm (i.e., the wide trapezoidal portion 234) is generally disposed on the sliding lever arm component. The locking mechanism of FIGS. 2A and 2B further includes one or more angled notches 264 disposed adjacent the second end 214 of the base 202. However, such a configuration is non-limiting. The angled notches 264 are configured to receive one or more flanges 262 disposed on the sliding handle 260. Once the lever arm 204 is in the fully closed configuration of FIG. 2B and it is desired to activate the locking mechanism, the sliding handle 260 is pulled along the stationary lever arm 258 until the flanges are positioned in front of the angled notches 264 in the base sidewalls 208, 210. The sliding handle is then pushed back down the stationary lever arm until the flanges are positioned within the angled notches, thereby locking the lever arm with respect to the base and maintaining the tension in the strap. In order to unlock the lever arm and base and to release the tension in the strap, the sliding handle 260 is pulled along its respective stationary lever arm portion 258 until the flanges 262 disengage from angled notches 264. The second end of the lever arm 204 can then be manually pivoted back away from the base and the one or more engagement features 246 of the cam 240 begin to disengage from the strap. Eventually, with continued rotation of the lever arm back toward the open configuration, the associated strap to able slide freely away from the one or more engagement features of the cam.

As illustrated in FIGS. 3A and 3B, the locking mechanism of tie-down device 300 includes one or more substantially flat stop walls disposed on the cam. In particular, tie-down device 300 includes a stop wall 358 disposed on sliding cam portion 344 and located adjacent the rotating cam portion 342 near the first end 312 of the base. Although not illustrated in FIGS. 3A and 3B, rotating cam portion 342 also includes a stop wall configured to engage with sliding stop wall 358. Once the sliding cam portion 344 has traveled the maximum distance permitted along the base sidewalls, the flat stop wall on the rotating cam portion 342 abuts a corresponding feature disposed on the side of sliding stop wall 358 which faces the rotation cam portion. This abutment creates a resistance point which locks the lever arm with respect to the base and maintains the tension in the strap. In order to unlock the lever arm and base and to release the tension in the strap, the second end of the lever arm 304 is manually pivoted back away from the base with enough force to overcome the resistance point between the flat stop walls. When the resistance point is overcome, the sliding cam portion 344 begins to move back toward the first end 312 of the base, releasing the tension exerted by the one or more engagement features. The strap can then slide freely away from the one or more engagement features. A lip on the end of guide wall 350*b* can be used to engage handle 330 and maintain the handle in position with respect to the guide wall. The lip can form a friction engagement with the handle; however, other types of engagements can be used to releasable secure the handle relative to the guide wall. The lip can be configured such that a user can easily lift the handle to cause the handle to disengage from the lip.

Turning now to FIGS. 4A-4B, FIGS. 5A-5D, and FIGS. 8A-8C, the locking mechanisms of tie-down devices 400, 500, and 800 include similar components and operates in similar manner to the locking mechanism of tie-down device 200 described above. In particular, the locking mechanisms of tie-down devices 400, 500, and 800 each include a two-part lever arm with a stationary portion 458, 558, 858 and a sliding portion or handle 460, 560, 860. Each also includes one or more angled notches 464, 564, 864 disposed on sidewalls 408/410, 508/510, and 808/810 of each base 402, 502, and 802, respectively. However, such a configuration is non-limiting. Instead of the one or more flanges in the locking mechanism of tie-down device 200, one or more recesses 462, 562, 862 are disposed on the sides of each lever arm 404, 504, and 804, respectively. The one or more recesses 462, 562, 862 are configured to receive the one or more angled notches 464, 564, 864. That is, each sliding handle 460, 560, 860 is able to be pulled along its respective stationary lever arm portion 458, 558, 858 until the recesses 462, 562, 862 are positioned in front of angled notches 464, 564, 864. The sliding handles can then be pushed back down the stationary lever arm portions until the angled notches are positioned within the recesses, thereby locking the lever arm with respect to the base and maintaining the tension in the strap. In order to unlock the lever arm and base and to release the tension in the strap, the sliding handles 460, 560, 860 are pulled along their respective stationary lever arm portions 458, 558, 858 until the angled notches 464, 564, 864 disengage from recesses 462, 562, 862. The second end of the lever arm 104 can then be manually pivoted back away from the base and the one or more engagement features 446, 546, and 846 of each cam 440, 540, 840 begin to disengage from the strap. Eventually, with continued rotation of the lever arm back toward the open configuration, the associated strap is able to slide freely away from the one or more engagement features of the cam.

With specific reference to the locking mechanism of tie-down device 800 illustrated in FIGS. 8A-8C, the sliding handle 860 can further include a biasing member 870, such as a spring, disposed on the stationary lever arm portion 858. The biasing member is configured to bias and automatically move the sliding handle 860 into engagement with the one or more notches 864. In such embodiments, a restrictor mechanism 872 is included which is configured to limit movement of the sliding handle 860 against the bias of the biasing member 870.

As illustrated in FIGS. 6A and 6B, the locking mechanism of tie-down device 600 includes a friction bar 658 disposed between the first and second sidewall 608, 610 and located generally adjacent the second end 614 of the base. However, such a configuration is non-limiting. The friction bar 658 includes at least one stopper 662 which is configured to frictionally engage a stop wall portion 660 located on the cam 640. Once the lever arm 604 is in the fully closed configuration of FIG. 6B and it is desired to activate the locking mechanism, the handle 630 is pushed to rotate the cam 640 and cause frictional engagement between the at least one stopper 662 of the friction bar 658 and the stop wall portion 660, thereby locking the lever arm with respect to the base and maintaining the tension in the strap. In order to unlock the lever arm and base and to release the tension in the strap, the handle 630 is pulled up to rotate the cam in the opposite direction overcome the frictional forces between the friction bar and the cam. The second end of the lever arm 604 can then be manually pivoted back away from the base and the one or more engagement features 646 of the cam 640 begin to disengage from the strap. Eventually, with continued rotation of the lever arm back toward the open configuration, the associated strap is able to slide freely away from the one or more engagement features of the cam.

Figure 7A:
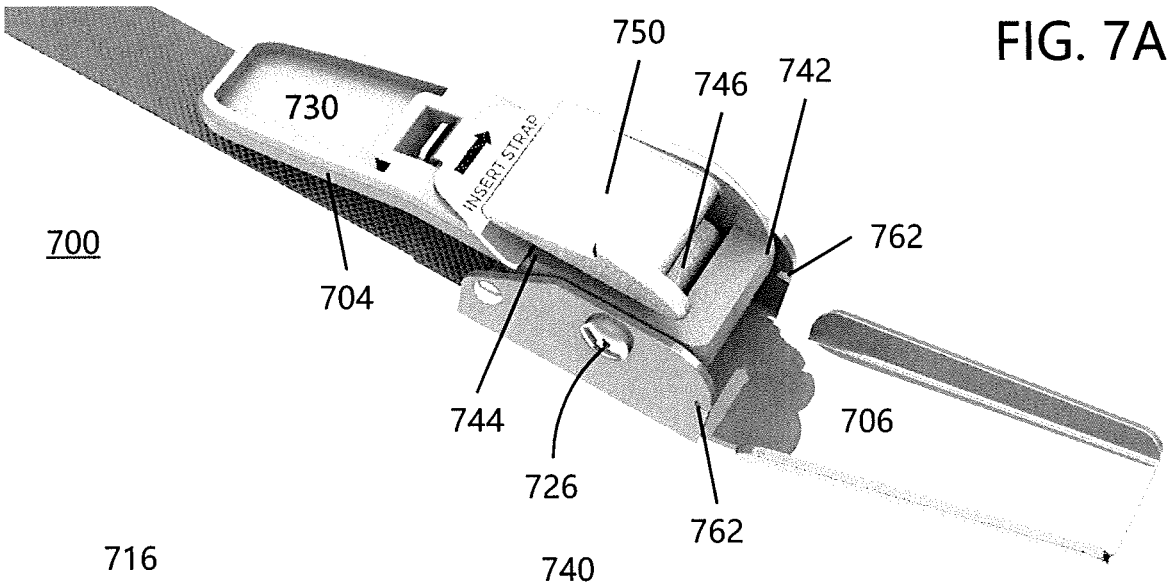
FIG. 7A is an illustration according to another non-limiting embodiment of the present disclosure showing an improved tie-down device in an open configuration and which includes a push tab for locking the device.
Figure 7B:
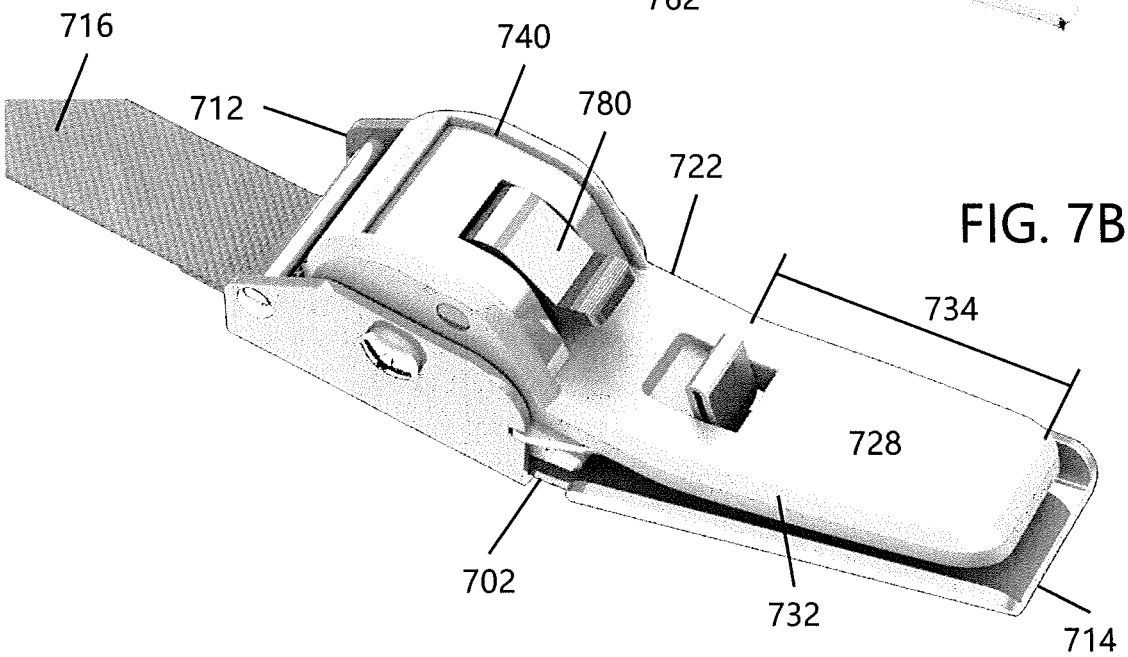
FIG. 7B is an illustration showing the improved tie-down device of FIG. 7A in a closed configuration which includes an optional release switch.
Figure 7C:
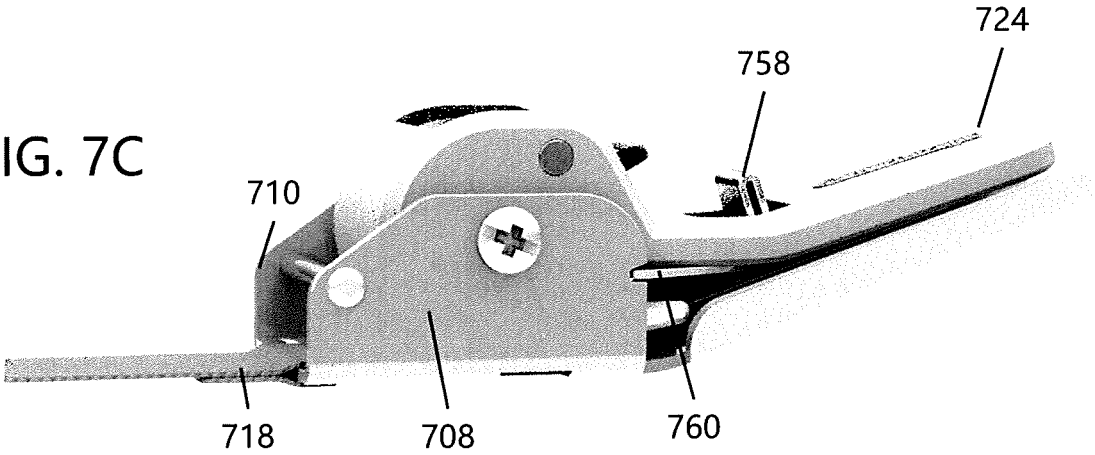
FIG. 7C is an illustration showing the improved tie-down device of FIG. 7A in a closed configuration and a fixed end of an associated strap attached to a base of the device.

As illustrated in FIGS. 7A-7C, the locking mechanism includes of tie-down device 700 includes a push tab 758 located on the lever arm 704 and configured to move a plate 760 which is generally disposed under the lever arm (i.e., below the bottom surface 730). The plate 760 is configured to fit into one or more corresponding recesses 762 formed in the first and second sidewalls 708, 710 of the base and located adjacent the second end thereof. However, such a configuration is non-limiting. Once the lever arm 204 is in the fully closed configuration of FIGS. 7B and 7C and it is desired to activate the locking mechanism, the push tab 758 is pushed toward the sidewalls of the base until the plate 760 mates with the one or more corresponding recesses 762, thereby locking the lever arm with respect to the base and maintaining the tension in the strap. In order to unlock the lever arm and base and to release the tension in the strap, the push tab 758 is pushed away from the first and second sidewalls until the plate 760 disengages from the one or more corresponding recesses 762. The second end of the lever arm 704 can then be manually pivoted back away from the base and the one or more engagement features 746 of the cam 740 begin to disengage from the strap. Eventually, with continued rotation of the lever arm back toward the open configuration, the associated strap is able to slide freely away from the one or more engagement features of the cam.

The tie-down devices 100-800 described herein can further include any number of other features that may be helpful in securing loads of various shapes and sizes. For example, a release switch configured to adjust tension in the associated strap could be included. As illustrated in the tie-down devices of FIGS. 5C, 7B, and 8B, a release switch (580, 780, 880, respectively) on each cam 540, 740, and 840 can be manually activated by a user to temporarily release the one or more engagement features 546, 746, 846 from the associated strap from when the tie-down device is in the closed configuration. The exemplary release switches 580, 780, 880 may be activated when unintentional over-tightening of the strap occurs so that the tension in the strap can be adjusted to a proper level.

While considerable emphasis has been placed herein on the structures and configurations of the preferred embodiments of the disclosure, it will be appreciated that other embodiments, as well as modifications of the embodiments disclosed herein, can be made without departing from the principles of the disclosure. These and other modifications of the preferred embodiments, as well as other embodiments of the disclosure, will be obvious and suggested to those skilled in the art from the disclosure herein, whereby it is to be distinctly understood that the foregoing descriptive matter is to be interpreted merely as illustrative of the present disclosure and not as a limitation thereof.

What is claimed:

1. A tie-down device, comprising:

a base frame including first and second sidewalls, and first and second end portions, said first end portion configured to be connected to an end portion of a strap, said first wall having a lower height than said second wall, said second end portion including an upper surface and side guide walls extending above said upper surface;

a lever arm pivotally supported on at least one of said first and second sidewalls of said base frame, said level arm movable between an open position and a closed position;

a cam located at one end of said lever arm and including one or more engagement features configured to grab a free end of the associated strap and hold the associated strap in tension, said one or more engagement features including one or more features selected from a group consisting of a series of ridges, a textured surface, a knurled surface, and one or more walls, said cam including a strap guide configured to align the associated strap with said one or more engagement features, said strap guide configured to enable a portion of said strap to be inserted between said strap guide and said one or more engagement features from said side of said strap guide when said level arm is in said open position, said one or more engagement features configured to initially grab the free end of the associated strap when said lever arm is positioned at an angle of at least 100° with respect to said base frame, said one or more engagement features configured to pull the associated strap a distance of about 0.25-3 inches when said lever arm is positioned at an angle of at least about 120° with respect to the base frame;

a locking mechanism configured to lock said base frame and lever arm together in a closed position or release said base frame and lever arm in an open position; and a release switch configured to adjust tension in the associated strap, said release switch positioned in said cam and is configured to be manually activated by a user to release said one or more engagement features from said strap when said lever arm is in said closed position; and wherein said closed position maintains tension in the associated strap and said open position releases tension in the associated strap; and wherein the associated strap is held in tension with said one or more engagement features of said cam when said lever arm is positioned at an obtuse angle with respect to said base frame; and wherein said level arm overlies said at least a portion of said second end portion when said lever arm is said closed position.

2. The tie-down device as defined in claim 1, wherein said locking mechanism further includes a biased locking and release arrangement configured to automatically move said locking and release arrangement into said locking position.

3. The tie-down device as defined in claim 2, wherein said locking mechanism is selected from the group consisting of a) a push tab, and b) a sliding handle disposed on said lever arm and configured to engage one or more notches disposed on said one or more sidewalls of said base frame to engage said sliding handle in a locking position, said sliding handle further including one or more flanges or one or more recesses configured to engage with said one or more notches.

4. The tie-down device as defined in claim 3, further comprising a restrictor mechanism configured to limit movement of the sliding handle against the biasing member.

5. The tie-down device as defined in claim 1, wherein said cam is not connected to said side guide walls, at least one of said side guide walls having a height that is less than said first and second side walls.

6. A method for using a tie-down device, comprising:

providing a base frame including first and second sidewalls, and first and second end portions, said first end portion configured to be connected to an end portion of a strap, said first wall having a lower height than said second wall, said second end portion including an upper surface and side guide wall extending above said upper surface; a lever arm pivotally supported on at least one of said first and second sidewalls of said base frame, said level arm movable between an open position and a closed position; a cam located at one end of said lever arm and including one or more engagement features configured to grab a free end of the associated strap and hold the associated strap in tension, said one or more engagement features including one or more features selected from a group consisting of a series of ridges, a textured surface, a knurled surface, and one or more walls, said cam including a strap guide configured to align the associated strap with said one or more engagement features, said strap guide configured to enable a portion of said strap to be inserted between said strap guide and said one or more engagement features from said side of said strap guide when said level arm is in said open position; a locking mechanism configured to lock said base frame and lever arm together in a closed position or release said base frame and lever arm in an open position; and a release switch configured to adjust tension in the associated strap, said release switch positioned in said cam and is configured to be manually activated by a user to release said one or more engagement features from said strap when said lever arm is in said closed position; wherein said closed position maintains tension in the associated strap and said open position releases tension in the associated strap; wherein the associated strap is held in tension with said one or more engagement features of said cam when said lever arm is positioned at an obtuse angle with respect to said base frame; and wherein said level arm overlies said at least a portion of said second end portion when said lever arm is said closed position;

inserting the free end of the associated strap into the cam;

rotating the lever arm until an angle of at least about 100° is formed with respect to the base frame, thereby grabbing the strap with the one or more engagement features of the cam;

rotating the lever arm until an angle of at least about 105° is formed with respect to the base frame, thereby increasing a tension in the strap with the one or more engagement features; and, locking the base frame and lever arm together with the locking mechanism to maintain the tension in the strap.

7. The method as defined in claim 6, wherein said locking mechanism further includes a biased locking and release arrangement configured to automatically move said locking and release arrangement into said locking position.

8. The method as defined in claim 7, wherein said locking mechanism is selected from the group consisting of a) a push tab, and b) a sliding handle disposed on said lever arm and configured to engage one or more notches disposed on said one or more sidewalls of said base frame to engage said sliding handle in a locking position, said sliding handle further including one or more flanges or one or more recesses configured to engage with said one or more notches.

9. The tie-down device as defined in claim 8, further comprising a restrictor mechanism configured to limit movement of the sliding handle against the biasing member.

10. The method as defined in claim 9, wherein said cam is not connected to said side guide walls, at least one of said side guide walls having a height that is less than said first and second side walls.

* * * * *